United States Patent [19]

Disston et al.

[11] Patent Number: 4,483,415

[45] Date of Patent: Nov. 20, 1984

[54] FOLDING STEPLADDER

[76] Inventors: Horace C. Disston; Timothy J. Eichfeld, both of 217 S. Hurffville Rd., Deptford, N.J. 08096

[21] Appl. No.: 515,559

[22] Filed: Jul. 20, 1983

Related U.S. Application Data

[63] Continuation-in-part of Ser. No. 264,299, May 18, 1981, abandoned.

[51] Int. Cl.[3] ..... E06C 1/20; E06C 1/383

[52] U.S. Cl. ..... 182/22; 182/156; 182/168; 182/129

[58] Field of Search ..... 182/163, 165, 166, 167, 182/168, 177, 129, 22, 24, 23, 156

[56] References Cited

U.S. PATENT DOCUMENTS

| | | | |
|---|---|---|---|
| 229,552 | 7/1880 | Phelps | 182/24 |
| 353,868 | 12/1886 | Koerner | 182/24 |
| 572,201 | 12/1896 | Hausmann | 182/168 |
| 2,997,127 | 8/1961 | Wojtowicz | 182/172 |
| 3,311,190 | 3/1967 | Naumann | 182/129 |
| 3,768,592 | 10/1973 | Higgins | 182/129 |
| 3,912,043 | 10/1975 | Brannan | 182/23 |

FOREIGN PATENT DOCUMENTS

| | | | |
|---|---|---|---|
| 430985 | 8/1967 | Switzerland | 182/24 |

*Primary Examiner*—Reinaldo P. Machado
*Attorney, Agent, or Firm*—Robert K. Youtie

[57] ABSTRACT

A ladder including a lower step section and a strut pivotally connected at their upper ends for swinging movement between a collapsed position one within the other and a downwardly divergent erected position, and an upper section pivoted to the upper end of the lower step section for swinging movement between a folded position closely overlying the lower step section and an erected position inclining as an extension of the lower step section.

6 Claims, 5 Drawing Figures

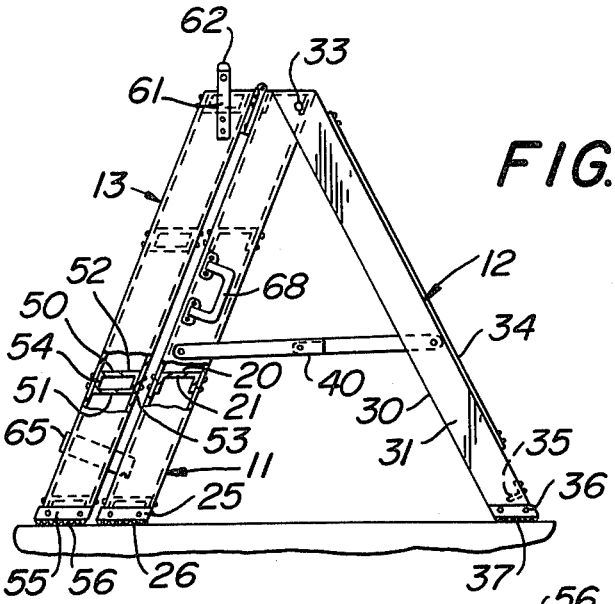
FIG. 3
FIG. 5
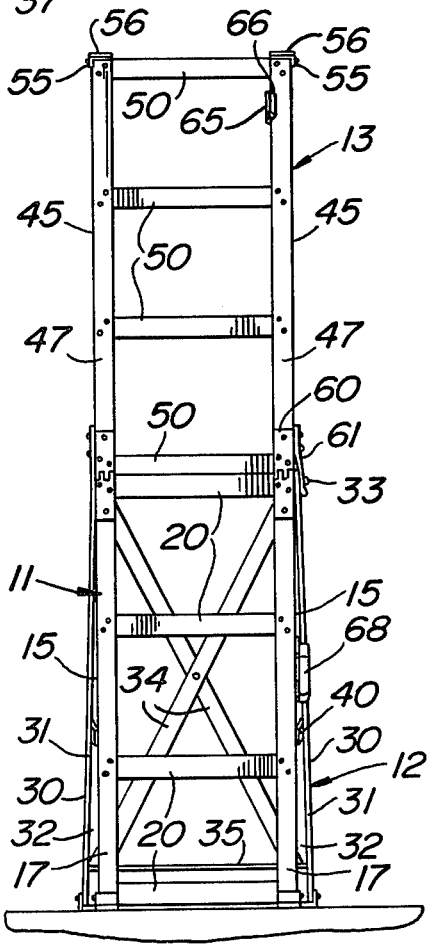
FIG. 4
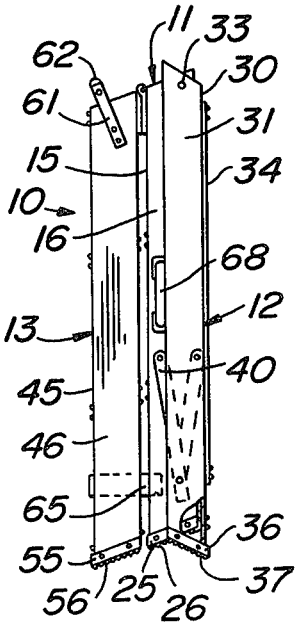

FOLDING STEPLADDER

CROSS-REFERENCES TO RELATED APPLICATIONS

This application is a continuation-in-part of my copending U.S. patent application Ser. No. 264,299, filed May 18, 1981.

BACKGROUND OF THE INVENTION

It is well known to those versed in the ladder arts that self-standing, collapsible ladders have been subject to serious size and height limitations resulting from requirements of stability in use, as well as bulk and weight in storage and for portability.

The applicant is aware of the below listed prior art patents:

| | PATENTEE |
|---|---|
| U.S. PAT. NO. | |
| 3,311,190 | Naumann |
| SWISS PATENT NO. | |
| 430,985 | Spoerle |

The relevancy of Spoerle is in the showing of a ladder having pivoted step sections, while the relevancy of Naumann is in the showing of a folding ladder with strut members overlapping the step section.

SUMMARY OF THE INVENTION

It is among the important objects of the present invention to provide a self-standing, collapsible ladder composed essentially of lower and upper step sections pivotally connected together, and a strut section pivotally connected to the lower step section adjacent to the pivotal connection between the step sections.

It is a further object of the present invention to provide a self-standing, collapsible ladder of the type described which is extremely sturdy in the erected condition by the relative shortness of the strut; capable of more closely approaching and directly facing a work surface than conventional collapsible ladders; occupying a minimum of space in storage by telescopic or nesting relationship of components one within the other for ease of portability; and wherein the step elements are hollow for weight reduction and the upper step elements are two-sided for use in both extended and retracted positions.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 3 is a side elevational view showing the instant ladder in a retracted condition of use.

FIG. 4 is a side elevational view showing the instant ladder in a collapsed condition for storage or portability.

FIG. 5 is a front elevational view of the extended ladder, as in FIG. 2.

DESCRIPTION OF THE PREFERRED EMBODIMENT

Figure 1:
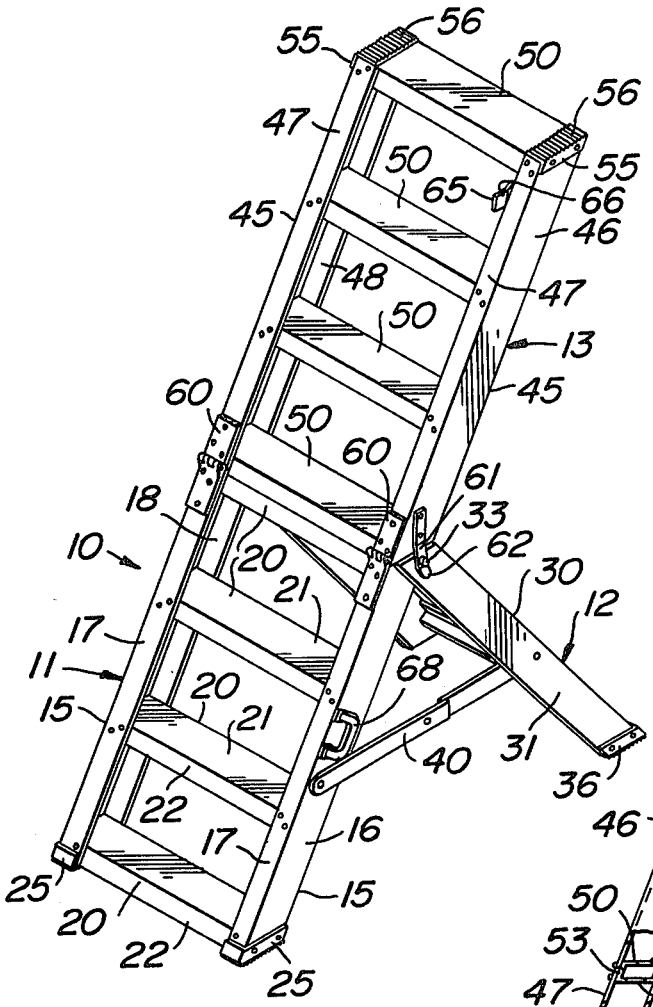
FIG. 1 is a front perspective view showing the ladder of the present invention in an extended position of use.
Figure 2:
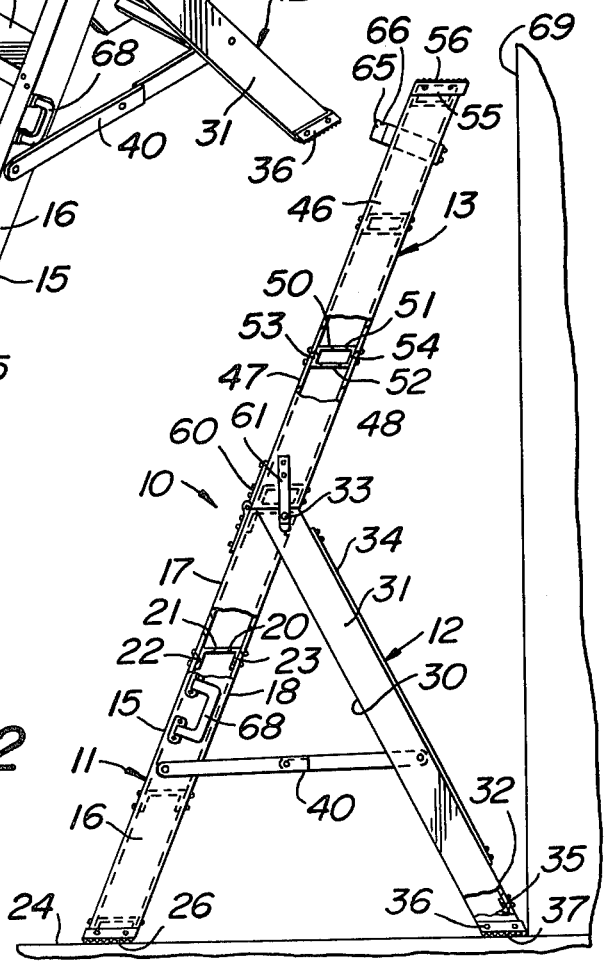
FIG. 2 is a side elevational view showing the ladder of FIG. 1 in relation to an upright work surface or wall.

Referring now more particularly to the drawings, and specifically to FIGS. 1 and 2 thereof, a collapsible, free standing or self-supporting ladder is there generally designated 10. The ladder 10 may include a lower front or step section 11 having its upper end pivotally connected to the upper end of a rear section or strut 12. An upper section 13 has its lower end, as seen in FIGS. 1 and 2, pivotally connected to the upper end of the lower section and extending upwardly therefrom and in alignment therewith.

Thus, in the extended or fully erected condition of the ladder 10, the upper section 13 extends in general alignment with and from the upper end of the lower section 11 beyond the upper end of the strut 12. In the partially erected, or retracted erected condition of FIG. 3, the upper section 13 is swung about its pivotal connection to the lower section 11, extending closely along and in front of the latter.

In the fully collapsed condition of FIG. 4, the sections 11 and 13 extend closely longitudinally along and in parallelism with each other, while the rear section or strut 12 extends closely along, in parallelism with and at least partially receiving the lower section 11. In this fully collapsed condition of FIG. 4, the three sections 11, 12 and 13 occupy a minimum of space; and, as the three sections are substantially equal in length, the lower extremities of the outer sections 12 and 13 are sufficiently close together so that the collapsed unit may be self standing on a generally horizontal support or floor surface.

More specifically, the lower section 11 may be composed of a pair of longitudinal members or side pieces 15, which may be substantially identical, but of opposite hand. Advantageously, the longitudinal members or side pieces 15 are fabricated of channel stock, each including a web 16 extending laterally between a pair of forward and rearward inturned flanges 17 and 18. Thus, the front flanges 17 of both side pieces or channels 15 are generally coplanar, as are the rear flanges 18.

A plurality of lateral members or steps extend generally horizontally in parallelism with each other at equally spaced elevations between the side members 15. Each step 20 is of a downwardly facing channel-like configuration, having its opposite end portions extending into the hollow of respective side members 15, the steps 20 each terminating with its opposite ends proximate to a respective side member web 16; and having a generally horizontal web or tread wall 21, and having forward and rearward depending flanges 22 and 23, respectively in facing engagement with and suitably secured to the front and rear side member flanges 17 and 18.

As best seen in FIGS. 1 and 2, the lower ladder section 11 inclines rearwardly, as from a supporting surface or floor 24, with the lower ends of the side members 15 generally horizontal, so as to be at an angle with respect to the longitudinal direction of the side members. Further, the steps or lateral members 20 are generally horizontal, both laterally and forwardly and rearwardly, while their depending flanges 22 and 23 decline forwardly for the above-mentioned facing engagement with flanges 17 and 18.

On the lower ends of side members 15 and 16 may be secured suitable lower end closures or caps 25, which may be provided on their undersides with frictional ground engaging material or footpads 26.

As illustrated, the lower section 11 may include four steps 20, with the lowermost and uppermost steps contiguous to the lower and upper ends of the side members 15; or other number and arrangement of steps, if desired.

The rear section or strut 12 may be composed of a pair of laterally spaced, generally parallel, elongate side members 30, each of which may be fabricated of anglestock including a major wall 31 and an inturned flange or rib 32. The walls 31 of the strut side members 30 have their upper end portions outwardly of and overlying the upper end portions of respective lower section side member walls 16, and pivotally secured thereto, as by a pivot pin 33. A single pivot pin 33 may extend between and through both strut side members 30; or, a pair of aligned pins may be employed at each side. Suitable limit means may be employed to prevent movement of the pivot pin 33 along its longitudinal direction, while maintaining one end of the pivot pin 33 projecting appreciably beyond one strut member wall 31, as best seen in FIG. 5.

The strut side members 30 are relatively immovably tied together, as by crossing braces 34 each extending diagonally between a lower region of one strut member 30 and upper region of the other strut member 30, and suitably secured to the strut member flanges 32. Also, the lower region of the strut side members 30 may be secured together by a lateral angle bar 35 having its opposite ends suitably secured to the flanges 32 of respective side members 30.

In the erected or use condition of FIGS. 1 and 2, the strut 12 declines rearwardly from the upper end of the lower step section 11, being approximately equal in length to the latter, and has its opposite ends generally horizontal. On the lower ends of the strut side members 30, may be provided end members or caps 36 which may have on their undersides frictional ground engageable pads or feet 37.

Thus, the pivotally connected lower section 11 and strut 12 diverge downwardly in the erected or set-up condition, and may be pivoted toward each other about their upper ends into a collapsed or nonuse condition.

As best seen in FIG. 5, the lateral internal dimension of the strut 12, between the inside surfaces of the side walls 30, is larger than the external lateral dimension of the lower section 11. If desired, the strut side members may diverge slightly from each other in the downward direction; and, as the strut side member walls 31 are pivotally connected at their upper ends on the outer sides of respective lower section side member walls 16, the lower section will swing into the strut upon collapsing movement toward each other, as best seen in FIG. 4. This partial telescoping or shoeboxing together of the lower section 11 and strut 12 makes for space savings in storage and during portage.

In order to limit outward swinging movement of the lower section 11 from the strut 12, and divergence therebetween in the erected condition, pivoted linkages 40 may be connected between the lower section and strut, as to the external surface of each lower section wall 16 and the internal surface of each strut wall 31. By the lateral divergence of strut side members 30, there is afforded space for each linkage 40 in the collapsed condition between its associated pair of side members 15 and 30, as seen in FIGS. 4 and 5.

The upper section 13 includes a pair of generally parallel ladder sides or longitudinal members 45, which may each be a channel, similar to the channels 15 of the lower section 11. Each upper section side member channel 45 may include a wall or web 46, and a pair of front and rear flanges 47 and 48. The channel side members 45 extend in parallelism with each other, and in respective alignment with channel side members 15 of the lower section, when in the extended position of use shown in FIGS. 1 and 2. Thus, each channel web or wall 46 will be in longitudinal alignment with a respective channel web or wall 16, and similarly channel flanges 47 and 48 will be in respective alignment with channel flanges 17 and 18.

A plurality of lateral members or steps 50 extend horizontally in parallelism with each other, and at equally spaced elevations between the upper section side members 45. The upper section steps 50 have their opposite ends extending between the side member flanges 47 and 48, and terminate proximate to the side member webs 46. As best seen in FIGS. 2 and 3, the upper section steps 50 may each be elongate and of a constant, box-like cross-sectional configuration. As seen in FIG. 2, the step members 50 each include upper and lower tread walls 51 and 52, and front and rear edge walls 53 and 54. Further, the edge walls 53 and 54 are advantageously in flush facing engagement with respective front and rear flanges 47 and 48, and as the latter incline rearwardly in alignment with the lower section, so do the edge walls incline rearwardly. The step members 50 are, accordingly, of a closed, parallelogram configuration in cross-section. Suitable securing means, such as rivets, welding, or the like, may be employed to secure the upper section steps 50 to the side members 45. Further, the steps 50 are secured in vertically spaced relation with each other, and with respect to the lower section steps 20, to form a substantially continuous ladder having approximately equal riser distances between steps. The lower and upper steps 50 of the upper section 13 are located at the lower and upper ends of the upper section, as when the ladder is extended in the position of FIGS. 1 and 2.

Connecting the upper and lower sections 13 and 11 for swinging movement between the extended position of FIGS. 1 and 2, and the retracted position of FIGS. 3 and 4 with the upper section extending closely along and in substantially coterminous parallelism with the lower section, are suitable hinge means, such as strap hinges 60. The strap hinges 60 may each include hinge parts respectively secured to adjacent portions of flanges 17 and 47, whereby the upper section 13 is swingable from its extended position to its retracted position.

In the retracted position of FIG. 3, it will be apparent that the upper section 13 is of a length substantially equal to that of the lower section 11; and that the upper and lower sections are substantially equal in length to that of the strut 12. Also, it will be apparent in FIG. 3 that the steps 50 of the upper section in its retracted position are substantially coplanar with the steps 20 of the lower section. Further, the previously lower wall 52 of each step 50 is now uppermost and substantially coplanar with the respective wall 21 of the adjacent lower section step 20. By this construction the upper and lower steps 20 and 50 combine in the retracted position of FIG. 3 to provide steps of greatly increased depth, for increased comfort and safety.

The distal ends of side members 45, uppermost in FIGS. 1 and 2, may be provided with end members or caps 55 and frictional pads or feet 56. As the ends of upper section side members 45 extend oblique to the longitudinal dimension of the side members, in the same manner as in the construction of the lower section 11, the opposite ends of both upper and lower sections 13 and 11 are substantially coplanar with each other in the retracted position of FIG. 3, so that the adjacent steps 20 and 50 at the hingedly connected end of the upper and lower section provide a coplanar step of substantial depth, while the ends of upper and lower sections remote from the pivotal connection are generally coplanar and in frictional ground engagement, as by pads or feet.

The hingedly connected ends of the lower and upper sections 11 and 13 are in end-to-end abutting engagement in the extended position of FIGS. 1 and 2, for effectively supporting a load on each section.

Further, a resilient leaf or latch bar 61 has one end suitably fixed to the upper section 13, on the outer side of wall 46, and includes a resilient free end 62 located and configured, as by an aperture, for snap interengagement over the projecting end of pivot pin 33 when the upper section is in its extended position. This is seen in FIGS. 1, 2 and 5, and serves to effectively retain the upper section in its extended position, as against vibration and other forces. Mere finger deflection of the latch 61 may release its holding engagement with pin 33 for relative swinging movement of the upper section 13 to its retracted position.

In the retracted position, a resilient strip or spring clasp 65 extends from one step section into snap retaining engagement with the other step section. For example, the spring clasp 65 may be secured to an upper or outer region of one side member 45 of the upper section 13, and provided with a resiliently deflectable nub or protrusion 66 for snap engagement past the flange 17 of the adjacent side member 15 in the retracted position. This serves to resiliently and releasably retain the sections 11 and 13 in their closed or retracted condition, as shown in FIG. 4. It will there be apparent that the lower extremities of the strut 12 and upper section 13 are adjacent to each other, and may serve for supporting engagement with a ground surface to maintain the collapsed ladder 10 in an upright condition for occupying a minimum of floor space. The spring strip or clasp 65 is formed on one longitudinal edge, the upper edge as seen in the erected conditions of FIGS. 1 and 2, with a notch 66 for receiving the bail of a paint can to conveniently suspend the can from the retainer strip or clasp.

Also, on the outside of one side member, say side member 15, there may be provided a hand grip or handle 68, spaced medially between opposite ends, and serving to permit of convenient portability.

It is apparent from the operative condition of FIG. 2, in relation to an upright work surface or wall 59, that the ladder 10 provides close and directly facing access to the work surface, in contrast to conventional folding ladders. Also, it has been found that a ladder of ample size is readily portable by its light weight ahd fabrication of aluminum extrusions, and minimum collapsed size, permitting of portage by car, through conventional doorways, including revolving doors, and even storage beneath a standard workbench. As the supporting structure namely the lower section 11 and the strut 12 are of less length than a conventional folding ladder, there is increased sturdiness with less flexibility and enhanced safety.

From the foregoing it is seen that the present invention provides a free standing, collapsible ladder which is extremely staunch, sturdy and durable, while affording maximum versatility in use, portability and storage, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A foldable ladder comprising a lower section for use inclined in one direction on a horizontal supporting surface, a series of parallel lower steps on said lower section and oblique thereto for generally horizontal disposition in use, a strut having one end pivotally connected to one end of said lower section for use inclined in the opposite direction on a horizontal suporting surface, said strut having its internal lateral dimension greater than the external lateral dimension of said lower section for relative swinging movement of said lower section toward and into said strut in the non-use condition, limit means connecting said lower section and strut for limited swinging movement away from each other, an upper section having one end pivotally connected to said one end of said lower section for swinging movement between an extended position in alignment with said lower section and a retracted position lying along said lower section, a series of parallel additional steps on said upper section and oblique thereto for generally horizontal disposition in both the extended and retracted positions, said additional steps being spaced for respective coplanarity with said lower steps when said upper section is in retracted position, a pivot pin effecting pivotal connection between said lower section and strut, and a latch on said upper section located for removable interengagement with said pin when said upper section is in said extended position.

2. A foldable ladder according to claim 1, said pin having one end extending beyond said lower section, and said latch being outward of said upper section for interengagement over said one pin end.

3. A foldable ladder according to claim 1, in combination with a resilient retainer carried by one of said lower and upper sections remote from said one ends thereof and releasably snap engageable in retaining relation with the other of said lower and upper sections.

4. A foldable ladder according to claim 1, in combination with a resilient retainer carried by one of said upper and lower sections remote from said one ends thereof and releasably snap engageable in retaining relation with the other of said lower and upper sections, said retainer being carried by said upper section and having a notch for receiving a paint can bail.

5. A foldable ladder according to claim 1, said lower steps having a concave underside in the use condition, said additional steps having generally planar opposite sides for use in both the extended and retracted positions.

6. A foldable ladder according to claim 1, said lower and upper sections and said strut being of substantially equal length for engagement of the other ends of said upper section and strut with a supporting surface in the retracted position, for increased stability.

* * * * *